US006116713A

United States Patent [19]

Maru

[11] Patent Number: 6,116,713

[45] Date of Patent: Sep. 12, 2000

[54] RECORDING APPARATUS HAVING TEMPERATURE DETECTING ELEMENT AND A TEMPERATURE DETECTION CORRECTION METHOD

[75] Inventor: Hiroyuki Maru, Atsugi, Japan

[73] Assignee: Canon Kabushiki Kaisha, Tokyo, Japan

[21] Appl. No.: 08/898,521

[22] Filed: Jul. 22, 1997

[30] Foreign Application Priority Data

Jul. 24, 1996 [JP] Japan ..... 8-194751

[51] Int. Cl.[7] ..... B41J 29/38

[52] U.S. Cl. ..... 347/17; 347/61; 347/68

[58] Field of Search ..... 347/17, 19, 40, 347/56, 68, 61, 14

[56] References Cited

U.S. PATENT DOCUMENTS

| | | | |
|---|---|---|---|
| 4,682,885 | 7/1987 | Torigoe . | |
| 5,331,340 | 7/1994 | Sukigara | 347/17 X |
| 5,485,179 | 1/1996 | Otsuka et al. | 347/17 X |
| 5,485,182 | 1/1996 | Takayanagi et al. | 347/17 |
| 5,646,655 | 7/1997 | Iwasaki et al. | 347/17 |
| 5,760,797 | 6/1998 | Koizumi et al. | 347/19 X |
| 5,771,049 | 6/1998 | Miura et al. | 347/17 X |
| 5,790,144 | 8/1998 | Eade et al. | 347/19 X |
| 5,838,341 | 11/1998 | Hiwada | 347/17 X |

FOREIGN PATENT DOCUMENTS

| | | |
|---|---|---|
| 61-132358 | 6/1986 | Japan . |
| 1-202466 | 8/1989 | Japan . |
| 2-48962 | 2/1990 | Japan . |
| 4-319450 | 11/1992 | Japan . |

*Primary Examiner*—Susan S. Y. Lee

*Attorney, Agent, or Firm*—Fitzpatrick, Cella, Harper & Scinto

[57] ABSTRACT

A recording apparatus is provided with a recording head including an element substrate having plural recording elements for recording and a temperature detecting element for detecting the temperature of the element substrate, and a temperature detecting unit for detecting the ambient temperature. The temperature detecting element is adapted to receive a predetermined signal and to output an output signal corresponding to the temperature of the element substrate. The recording apparatus further includes a correction circuit for correcting the signal to be given to the temperature detecting element, based on the output signal of the temperature detecting element and the output signal of the temperature detecting unit, in such a manner the output signal of the temperature detecting element at a certain temperature becomes a predetermined output.

15 Claims, 8 Drawing Sheets

RECORDING APPARATUS HAVING TEMPERATURE DETECTING ELEMENT AND A TEMPERATURE DETECTION CORRECTION METHOD

BACKGROUND OF THE INVENTION

1. Field of the Invention

The present invention relates to a recording apparatus utilizing an electrothermal converting element, and more particularly to an ink jet recording apparatus provided with a temperature detecting-correcting circuit for detecting the heat generated by the electrothermal converting element as temperature. The present invention also relates to an ink jet recording apparatus for effecting recording by discharging ink, utilizing the electrothermal converting element.

2. Related Background Art

FIG. 8 is a schematic circuit diagram of a conventional ink jet recording element substrate, wherein shown are an ink jet recording element substrate 501, a temperature detecting diode 502 for detecting the heat generated by a heater as temperature, electrothermal converting elements (heaters) 504 for generating thermal energy, switches 505 for determining the timing for current supply to the heaters, a power supply line 506 for applying a predetermined voltage to the heaters, thereby supplying current thereto, power transistor units 508 for supplying the heaters with desired currents, an ink discharge data unit 509 for transferring and storing, for each heater, data whether or not to supply each heater with the current for ink discharge, and a pulse width calculation unit 510 for measuring the voltage of the temperature detecting diode 502, converting the measured voltage into temperature and calculating the turn-on time of the switches 505. There is already known such substrate on which the electrothermal converting elements (heaters), the driving circuits therefor and the temperature detecting elements are integrally formed.

FIG. 9 is a chart showing pulses of different widths for turning on the switch 505 so as to obtain a substantially same ink discharge amount at different temperatures T, FIG. 10 is a chart indicating the conversion of the output voltage of an ideal temperature detecting diode 502, whose characteristics are known, into the temperature, and FIG. 11 is a chart for calculating the pulse width for turning on the switch 505, based on the temperature converted from the voltage. In these charts, 701, 702 and 703 are points indicating the temperatures at different voltages, and 801, 802 and 803 are points indicating the pulse widths at different voltages.

FIG. 12 is a circuit diagram showing the details of the function of the temperature detecting diode and the pulse width calculation unit shown in FIG. 8, wherein shown are an ink jet recording element substrate 901, and a temperature detecting diode 902. In this example there are employed two temperature detecting diodes. There are also shown a resistance 903 of an aluminum wiring between the temperature detecting diode and an external electric contact (pad), a heater (electrothermal converting element) 904, a switch 905, a power supply line 906, an external electrical contact (pad) 907, a pulse width calculation unit 910, an absolute temperature detecting unit 911, an arithmetic operation unit 912 for reading the data of the absolute temperature detecting unit 911 and of a monitor 915 and outputting a pulse width, a constant current source 914 for supplying the temperature detecting diodes 902 with a constant current $I_F$, and a monitor 915 for measuring a voltage $2V_F$ corresponding to the two diodes 902 when the current $I_F$ is supplied thereto from the constant current source 914.

Data of a number corresponding to that of the heaters 504 (904) and the power transistor units 508 are supplied to and stored in the ink discharge data unit 509 shown in FIG. 5. By turning on the switch 505 (905) for an appropriate period, a current is supplied to the power transistor unit 508 and the heater 504 through the power supply line 506, according to such period. If the turn-on time of the heater 504 is so set as to obtain a desired ink dot diameter in an initial state where the temperature is stable and the current supply is repeated with such a turn-on period, the heat generated by the heater 504 is transmitted to the ink through the element substrate with the lapse of time, whereby the viscosity of ink varies, inducing a variation in the ink discharge characteristics. Therefore, if the heater is turned on with the same time as in the initial state, the ink discharge amount increases to form a larger dot at the ink landing spot, whereby the image density becomes uneven.

The temperature of the element substrate is detected in order to avoid such drawback. In the following there will be explained the method of temperature detection, with the two diodes shown in FIG. 12. In a state where the heater 904 is not activated and the ink jet recording element substrate 901 and the pulse width calculation unit 910 are in a stable state of the same temperature, the absolute temperature $T_O$ is measured by the absolute temperature detection unit 911. Also a constant bias current $I_F$ is supplied by the constant current source 914 to the temperature detecting diodes 902, and the voltage $2V_{FO}$ thereof is measured by the monitor 915. In this manner the diode voltage $2V_{FO}$ at the temperature $T_O$° C. can be obtained as a number value, and, even in the presence of a temperature increase in the ink jet recording element substrate 901, the temperature T thereof can be estimated from a temperature coefficient $2\cdot\partial V_F/\partial T$, $2V_{FO}$, $2V_F$ and $T_O$ according to the following equation:

$$T=T_O+(2V_F-2V_{FO})/(2\cdot\partial V_F/\partial T) \quad \text{(A)}$$

Based on the thus calculated temperature T, the desired pulse width corresponding to the desired ink discharge amount is determined from the curve in FIG. 11. It is therefore rendered possible, even when the temperature of the ink jet recording element substrate 901 rises, to obtain a constant ink discharge amount, thereby obtaining the ink dots of a constant diameter, by turning on the switch 905 with such a pulse width.

In the following a more detailed explanation will be given with reference to FIGS. 8 to 11. It is assumed that the reference temperature in the initial state is T=25° C. as shown in FIG. 9, and that the switch 505 is given a turn-on time (pulse width) $t_2$ corresponding to such a reference temperature. Repetition of the heat generation under such conditions increases the temperature of the ink jet recording element substrate 501 by the heat generated by the heater 504, whereby the temperature of the ink also rises. The pulse width calculation unit 510 (910) reads the output $2V_F$ of the temperature detecting diodes 502 (902) and obtains the temperature based on the temperature characteristic curve based on $2V_{FO}$ and $T_O$ as shown in FIG. 10 and the obtained output $2V_F$. Thus, the temperature T is identified as 70° C. if $2V_F=2V_{F(70)}$. FIG. 11 shows a characteristic curve indicating the correspondence between the pulse width and the detected temperature, for obtaining a certain ink discharge amount. The pulse width for obtaining, at 70° C., an ink discharge amount the same as that at 25° C. is determined from FIG. 11, and is identified as $t_3$ (narrower than $t_2$ by $\Delta t_2$) indicated by a point 803 corresponding to 70° C. Then the switch 505 is given a signal of a pulse width $t_3$, whereby the same landed ink spot can be obtained even in the elevated temperature state of the ink. Also in case the external temperature drops and is identified as T=−10° C., a pulse width $t_1$ indicated by a point 801 is similarly selected from FIG. 11. The characteristic curve shown in FIG. 11 defines the condition for obtaining a constant ink discharge amount (ink amount at the ink landing point), and this characteristic curve remains the same both in the conventional configuration and in the embodiments of the present invention.

FIG. 13 is a detailed block diagram of the pulse width calculation unit 901 shown in FIG. 12, wherein shown are an absolute temperature detecting unit 1011, an arithmetic operation unit 1012, a constant current source 1014, a monitor 1015 for detecting $V_F$, an amplifier 1021, an A/D (analog-to-digital) converter 1022, a CPU 1024, another A/D converter 1025, an operation program 1026, a bias resistor 1027, and a temperature-dependent variable resistor 1028.

The temperature of the substrate 901 can be detected according to the foregoing equation (A), from the temperature T obtained in the absolute temperature detection unit 1011 and the voltage $V_F$ of the diode 902 of the substrate 901 obtained by the monitor 1015. The substrate temperature thus obtained can be converted into the desired pulse width for providing the constant ink discharge amount, based on the pulse width-temperature characteristics shown in FIG. 11.

However, the conventional technology explained above has been associated with the following drawbacks:

1. In the foregoing description of the conventional technology, the temperature detecting diodes 502 provided on each substrate or head are assumed to have the ideal characteristics as shown in FIG. 10 and to be free from any fluctuation in the characteristics. In fact, they show a certain fluctuation in the characteristics in the manufacturing process, but the extent of such fluctuation cannot be measured since such measurement has to be made by giving a temperature change to each substrate or head. For this reason, the characteristics have been estimated from the experience in the past.
2. Such fluctuation in the temperature characteristics provides a detected temperature higher or lower than the actual temperature. The pulse width for obtaining the predetermined ink discharge amount is determined, according to the pulse width-temperature curve shown in FIG. 11, by such detected temperature, the turn-on time of the switch 505 (905) involves an error whereby the ink discharge amount shows a considerable variation to result in a change in the size of the landed ink dot.
3. The heater 504 (904) may be given a current for an unnecessarily long period for the above-mentioned reason, so that the service life of the heater may be shortened in comparison with the case where the current is given only for the desired period.

SUMMARY OF THE INVENTION

An object of the present invention is to resolve the error in the temperature measurement, resulting from the fluctuation of the temperature characteristics of the temperature detecting elements among different heads.

Another object of the present invention is to provide an ink jet recording apparatus capable of providing an ink dot of a substantially constant size by providing a drive signal according to the substrate temperature which is thus made free from the error.

According to the present invention, there is provided a recording apparatus comprising a recording head including an element substrate provided with plural recording elements for recording and a temperature detecting element for detecting the temperature of the element substrate; a temperature detecting unit for detecting the ambient temperature; wherein the temperature detecting element is adapted to receive a predetermined signal and to output an output signal corresponding to the temperature of the element substrate; and a correction circuit for correcting the signal to be given to the temperature detecting element, based on the output signal of the temperature detecting element and the output signal of the temperature detecting unit, in such a manner that the temperature detecting element provides a predetermined output signal at a certain temperature.

In such apparatus, the temperature detecting element can be a pn junction diode.

Also the correction circuit can be a circuit which effects correction, utilizing the relationship between the temperature-dependent variation rate of the output voltage and the output voltage.

According to the present invention, there is also provided another recording apparatus comprising a recording head including an element substrate provided with plural recording elements for recording and a temperature detecting element for detecting the temperature of the element substrate; a temperature detecting unit for detecting the ambient temperature; wherein the temperature detecting element is composed of a pn junction diode; and a correction circuit for correcting the output voltage from the temperature detecting element, utilizing the above-mentioned ambient temperature and the relationship between the temperature-dependent variation rate of the output voltage and the output voltage.

The recording element in the above-mentioned recording apparatus can be a heat generating member.

Also, the recording apparatus can be such that a discharge opening and an ink path are provided corresponding to each of the recording elements and such and that the recording element is adapted to discharge ink from the discharge opening by giving discharge energy to the ink contained in the ink path.

There may be further provided means for transporting a recording medium on which the recording is to be made.

Also the recording element can be a piezoelectric element.

According to the present invention, there is also provided an ink jet recording apparatus comprising an element substrate provided with plural electrothermal converting elements for discharging ink; a temperature detecting element composed of a pn junction diode for detecting the temperature of the substrate; a constant current source for supplying the temperature detecting element with a variable constant current; a monitor for measuring the voltage generated in the temperature detecting element by the above-mentioned constant current; an absolute temperature detecting unit for detecting the absolute temperature outside the head; and an arithmetic operation unit for calculating the relationship between the absolute temperature and the detected voltage from the detected absolute temperature and the voltage detected by the monitor, and effecting control so as to drive the electrothermal converting element for a period corresponding to the voltage detected by the monitor; wherein the output current of the constant current source is variably controllable by the arithmetic operation unit and the arithmetic operation unit is adapted to control the output current of the constant current source in such a manner that the voltage detected by the monitor becomes a constant voltage corresponding to the absolute temperature.

There is also provided still another ink jet recording apparatus comprising an element substrate provided with plural electrothermal converting elements for discharging ink; a temperature detecting element composed of a pn junction diode for detecting the temperature of the substrate; a constant current source for supplying the temperature detecting element with a constant current; a monitor for measuring the voltage generated in the temperature detecting element by the above-mentioned constant current; an absolute temperature detecting unit for detecting the absolute temperature outside the head; and an arithmetic operation unit for calculating the relationship between the absolute temperature and the detected voltage from the detected absolute temperature and the voltage detected by the monitor, and effecting control so as to drive the electrothermal converting element for a period corresponding to the voltage detected by the monitor; wherein the arithmetic operation unit calculates the relationship between a voltage $V_F$ obtained when a bias current is applied to the temperature detecting element and $\partial V_F/\partial T$, based on the voltage $V_F$ and the absolute temperature T, thereby effecting temperature correction based on the output voltage.

In such ink jet recording apparatus, the absolute temperature detecting unit can be an analog-digital converter provided with a temperature-dependent variable resistor; the monitor can be an analog-digital converter provided with an amplifier; and the constant current source with variable output current can be provided with a digital-analog converter and an operational amplifier.

Also the temperature detecting element can be a pn junction diode and may be connected in n ($n \geqq 3$) units.

DETAILED DESCRIPTION OF THE PREFERRED EMBODIMENTS

Figure 1:
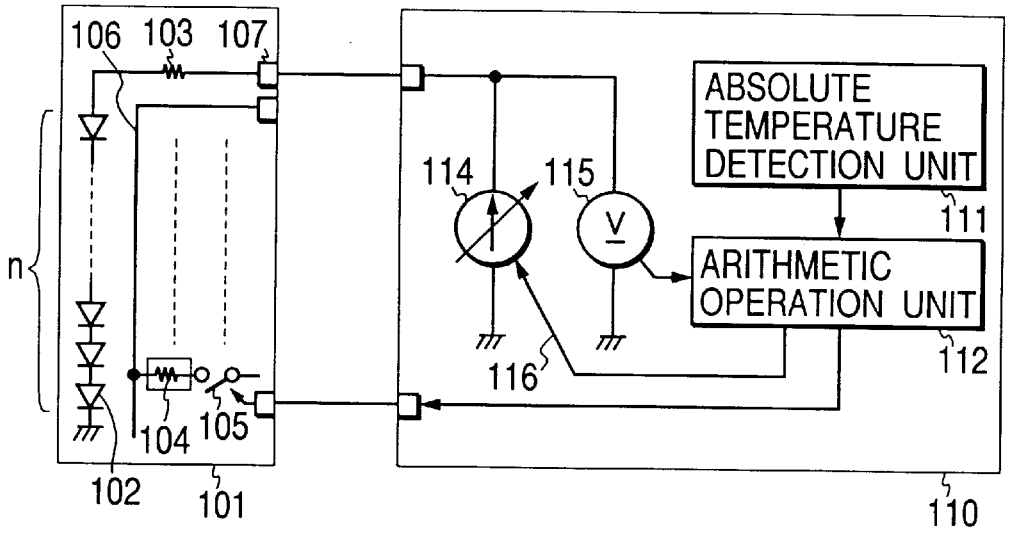
FIG. 1 is a circuit diagram showing the function of a temperature detecting element and a pulse width calculation unit in a first embodiment of the present invention.

Now the present invention will be explained in detail by preferred embodiments thereof.

In the present invention, the term "recording" refers not only to providing the recording medium with a meaningful image such as a character or a graphic image but also to providing a meaningless image, such as a pattern. Also, the present invention is applicable to recording on various recording media such as paper, yarn, fiber, textile, leather, metal, plastics, glass, timber, ceramics etc. and to various apparatus such as a printer, a copying machine, a facsimile apparatus provided with a communication system, a word processor provided with a printer unit, or an industrial recording apparatus combined with various processing devices in complex manner.

Also the term "element substrate" used hereinafter does not mean a mere substrate composed of a silicon semiconductor but refers to a substrate on which various elements and wirings are provided.

Also, the term "on the element substrate" not only indicates a position on the element substrate but also includes the surface thereof and the interior of the element substrate close to the surface thereof. Also, the term "built-in" does not mean merely positioning separate elements on the substrate but integrally forming the elements on the element substrate for example by a process used for producing semiconductor circuits.

The following embodiments will be explained by a bubble jet recording head which employs a heat generating element, capable of generating thermal energy, as the recording element, and discharges ink from a discharge opening communicating with an ink path by a film boil phenomenon, induced by giving the heat generated by the heat generating element to the ink contained in the ink path, but the present invention is not limited to such embodiment and is applicable also to an ink jet recording head employing a piezoelectric element, such as the recording element or a thermal transfer recording head, as long as the head is provided with a temperature detecting element. However, in consideration of the accuracy of temperature detection by the temperature detecting element, there is preferred a head in which the temperature detecting element is build in the element substrate bearing the heat generating element.

In the following there will be explained the theoretical background of the embodiments of the present invention. At first, the relationship between $V_F$ and $\partial V_F/\partial T$ is determined from the theoretical current-voltage relation of the diode. The Rider-Shockley diode equation can be developed as:

$$V_F=(k\cdot T/q)\ln(I_F/I_S) \tag{1}$$

$$I_S=Ae\cdot q\cdot ni\cdot ni\cdot(Dh/(Nd\cdot Lh)+De/(Na\cdot Le)) \tag{2}$$

$$ni\cdot ni=K_1\cdot T^3\cdot\exp(-Eg/(k\cdot T)) \tag{3}$$

wherein Ae: junction area, ni: intrinsic semiconductor carrier concentration, Dh: positive hole diffusion constant, De: electron diffusion constant, Nd: N-type impurity concentration, Na: P-type impurity concentration, Lh: positive diffusion length, Le: electron diffusion length, Eg: intrinsic semiconductor energy gap, $K_1$: constant and k: Boltzman's constant.

By differentiating $V_F$ with T in the equations (1) to (3), there can be obtained:

$$\partial V_F/\partial T=V_F/T-((k\cdot T)/q)(3/T+Eg)/(k\cdot T\cdot T) \tag{4}$$

By rewriting the equations with respect to $V_F$, there can be obtained:

$$V_F=(k\cdot T/q)1\ \mathrm{n}(I_F/(A\cdot T\cdot T\cdot T)+Eg/q) \tag{5}$$

$$A=Ae\cdot q\cdot k(Dh/(Nd\cdot Lh)+De/(Na\cdot Le)) \tag{6}$$

By substituting the equation (5) into (4), there can be obtained:

$$\partial V_F/\partial T=(k/q)\ln(I_F/(A\cdot T\cdot T\cdot T))-3k/q+Eg(1-T)/(q\cdot T) \quad (7)$$

The equations (5) to (7) indicate that the variable factors in the manufacturing process of the diode are collectively treated by a variable A and are represented by an equation in which the variable A appears in the denominator of a fraction while variable $I_F$ appears in the numerator thereof, so that the variation in the variable A can be canceled by a variation in $I_F$.

Also these equations indicate that $V_F$ and $\partial V_F/\partial T$ can mutually assume desired values by the selection of $I_F$, and that $\partial V_F/\partial T$ can be determined once $V_F$ is determined while $V_F$ can be determined once $\partial V_F/\partial T$ is determined. Consequently there stands a one-to-one relationship between $V_F$ and $\partial V_F/\partial T$.

In the following there will be given a detailed explanation on the specific embodiments of the present invention, with reference to the attached drawings. FIG. 1 is a circuit diagram showing the functions of a temperature detecting diode and a pulse width calculation unit in a first embodiment of the present invention, wherein shown are an ink jet recording element substrate 101; temperature detecting diodes 102 of a number n (n≧3) constituting temperature detecting elements; a resistance 103 of a metal (aluminum) wiring between the temperature detecting diodes and an external electric contact (pad); a recording element 104 composed, in the present embodiment, of a heat generating element (heater) capable of generating thermal energy by receiving an electrical signal; a switching element 105; a power supply line 106; and an external electrical contact (pad) 107. These temperature detecting diodes, wiring, heat generating element, switching element, power supply line, external electrical contact etc. are built in the ink jet recording element substrate. FIG. 1 shows only one set of the heat generating element and the switching element, but, in the actual substrate, plural sets of these elements are formed in succession. There are further shown in pulse width calculation unit 110; an absolute temperature detecting unit 111; an arithmetic operation unit 112 for reading the data of the absolute temperature detecting unit 111 and the data of a monitor 115 and outputting a pulse width; a variable constant current source 114 for supplying the temperature detecting diodes 102 with a constant current $I_F$; a monitor 115 for measuring the voltage $nV_F$ of the n diodes 102 when the current $I_F$ is given thereto by the constant current source 114; and a control line 116 for controlling the variable constant current source 114 from the arithmetic operation unit 112.

Figure 2:
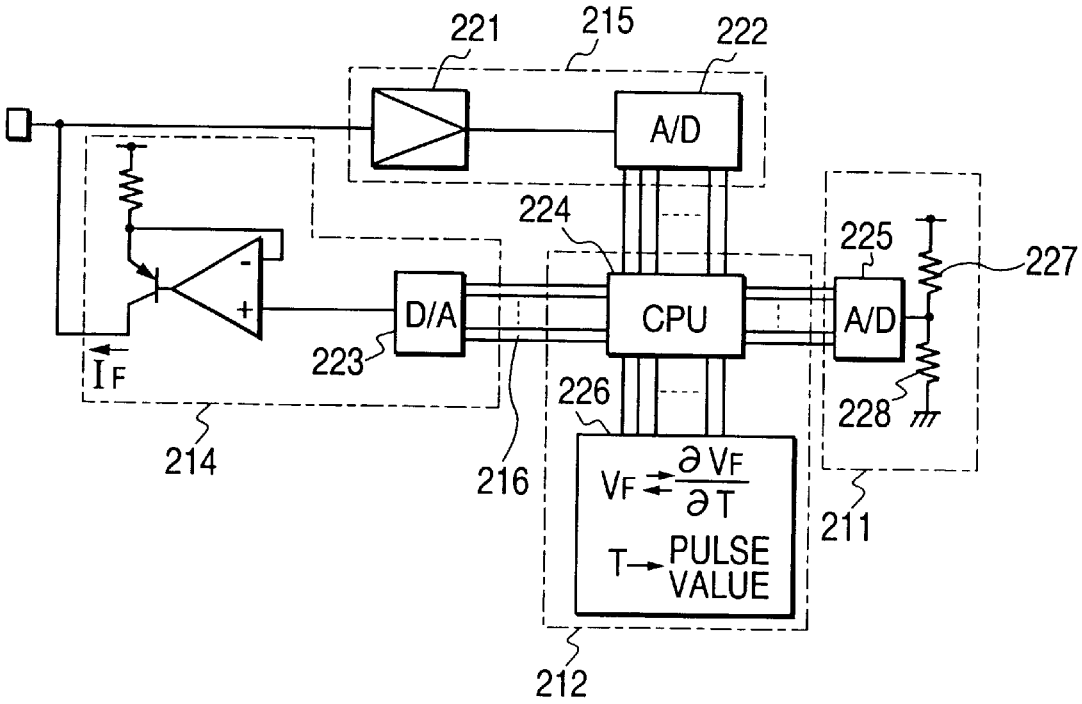
FIG. 2 is a detailed block diagram of the pulse width calculation unit 110 shown in FIG. 1.

FIG. 2 is a detailed block diagram of the pulse width calculation unit 110 shown in FIG. 1, wherein shown are an absolute temperature detecting unit 211, an arithmetic operation unit 212, a variable constant current source 214, a monitor 215 for detecting $V_F$, a control line 216, an amplifier 221, an A/D (analog-to-digital) converter 222, a D/A (digital-to-analog) converter 223, a CPU 224, an A/D converter 225, an operation program 226, a bias resistor 227, and a temperature-dependent variable resistor 228.

Based on the temperature T obtained by the absolute temperature detecting unit 211 and $nV_F$ obtained by the monitor 215, the arithmetic operation unit calculates $nV_FI$ in the temperature detecting element with ideal characteristics at T° C. according to the equations (5) to (7), and effects feedback control by varying the current $I_F$ of the variable constant current source 214 by means of the control line 216 in such a manner that $nV_F$ obtained by the monitor 215 becomes equal to the ideal value $nV_FI$.

Figure 8:
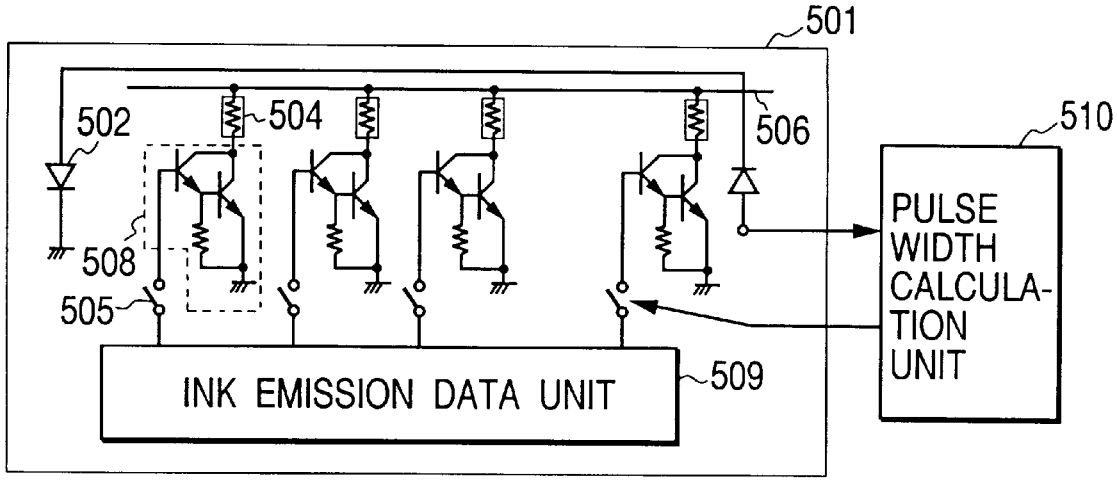
FIG. 8 is a schematic circuit diagram of a conventional element substrate for the ink jet recording head.

Then the current $I_F$ of the variable constant current source 214 is fixed, and the temperature of the substrate 101 can be precisely measured by monitoring the voltage $nV_F$ of the diodes 102 of the ink jet recording element substrate because such voltage shows a behavior the same as the ideal temperature characteristics without fluctuation. The pulse width can be obtained from the thus measured substrate temperature, according to the pulse width-T-relationship giving a constant ink discharge amount as shown in FIG. 8.

In this manner, the temperature can be measured with a high precision, and the heater can be given the current for an optimum period in precise a manner for each temperature. Consequently, the ink discharge amount becomes constant to provide a constant dot size at the ink landing point, whereby high image quality and high definition can be achieved in the recorded image. Also the heater, being prevented from receiving the current for an excessively long period, can provide a longer service life.

As explained in the foregoing, the measurement of $nV_F$ at an arbitrary temperature allows the apparatus to calculate $\partial V_F/\partial T$ without the test for the temperature characteristics, and the highly precise temperature measurement can be realized from the relationship of $V_F$ and $\partial V_F/\partial T$, so that the temperature characteristics can be managed by the management of $nV_F$.

In this embodiment there are provided temperature detecting diodes of a number larger than that in the foregoing example. In the conventional configuration shown in FIG. 9, if the voltage $2V_F$ generated in the two temperature detecting diodes 902 by the bias current $I_F$ supplied from the constant current source 914, 1014 is taken as the signal S, the product $R_{a1}\times I_F$ of the resistance $R_{a1}$ of the aluminum wiring 903 and the bias current $I_F$ corresponds to a noise N, and the voltage monitor 915 fetches both the signal S and the noise N, thus providing a value which is different from the actual temperature by such noise N.

In contrast, in the present embodiment, the serial connection of n diodes 102 increases the signal S from 2s to nS while the product $R_{a1}\times I_F$ of the resistance $R_{a1}$ of the aluminum wiring 103 and the bias current $I_F$ remains same as in the conventional configuration regardless of the number of the diodes, so that the S/N ratio can be improved to n/2 times in comparison with the conventional configuration and the proportion of the voltage drop, caused by the resistance 103 of the aluminum wiring, can be reduced to a negligible level.

Figure 3:
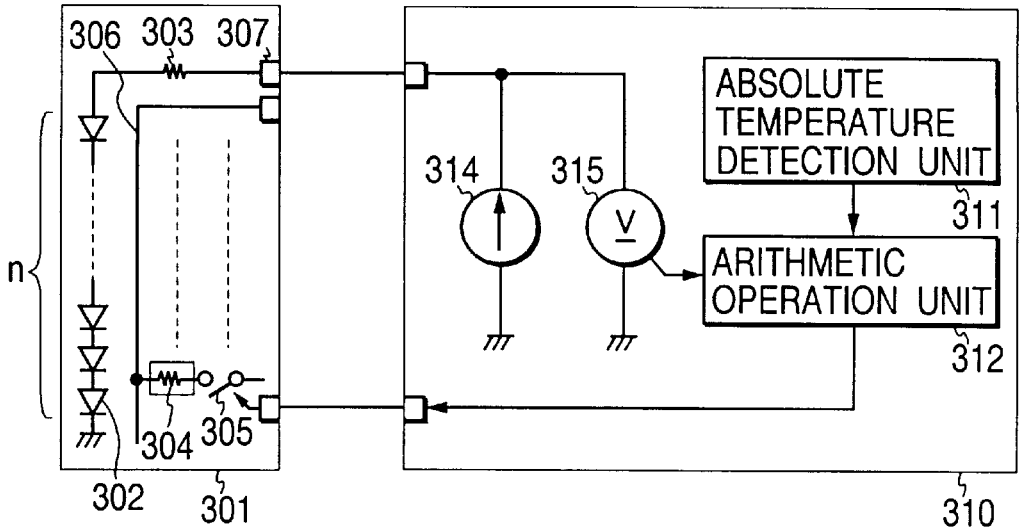
FIG. 3 is a circuit diagram showing the function of a temperature detecting diode and a pulse width calculation unit in a second embodiment of the present invention.

FIG. 3 is a circuit diagram showing the functions of temperature detecting diodes and a pulse width calculation unit in a second embodiment of the present invention, wherein shown are an ink jet recording element substrate 301; temperature detecting diodes 302 of a number n (n≧3); a resistance 303 of a metal (aluminum) wiring between the temperature detecting diodes and an external electric contact (pad); a heater 304; a switch 305; a power supply line 306; an external electrical contact (pad) 107; a pulse width calculation unit 310; an absolute temperature detecting unit 311; a second arithmetic operation unit 312 for reading the data of the absolute temperature detecting unit 311 and the data of a monitor 315 and outputting a pulse width; a constant current source 314 for supplying the temperature detecting diodes 302 with a constant current $I_F$; and a monitor 315 for measuring the voltage $nV_F$ of the diodes 302 when the current $I_F$ is given thereto by the constant current source 314.

In comparison with the first embodiment, the constant current source 314 in the present embodiment generates a fixed current only, and the control line 116 is not provided.

In the first embodiment, the current $I_F$ is rendered variable by the variable constant current source 114 to correct the output of the diodes 102 so as to provide the ideal temperature characteristics, and the turn-on time of the switch 105 is calculated by the arithmetic operation unit 112, but, in the second embodiment, the arithmetic operation unit 312 derives, without varying the current $I_F$ from the constant current source 314 and thus without correcting the fluctuation in the characteristics of the diodes, the temperature characteristics of the diodes from the relationship of $V_F$ and $\partial V_F/\partial T$ based on the temperature measured by the absolute temperature detecting unit and the voltage of the diodes at such measurement, and achieves highly precise measurement of the temperature based on the thus determined temperature characteristics.

Figure 4:
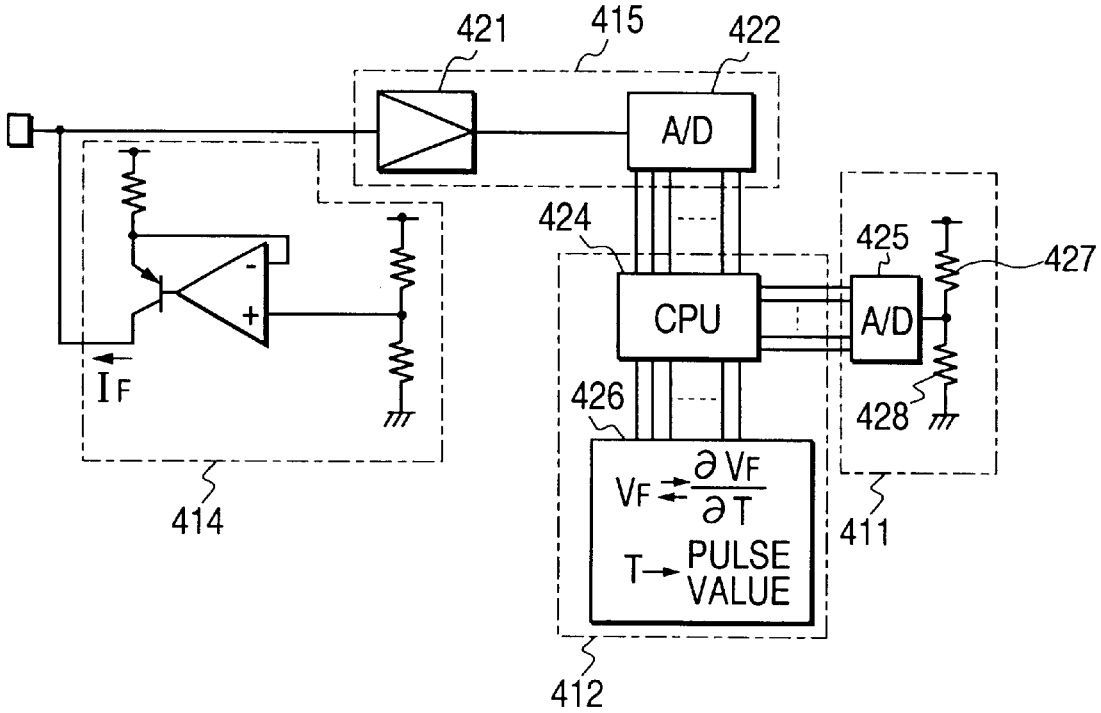
FIG. 4 is a detailed block diagram of the pulse width calculation unit 310 shown in FIG. 3.

FIG. 4 is a detailed block diagram of the pulse width calculation unit 310 shown in FIG. 3, wherein shown are an absolute temperature detecting unit 411, an arithmetic operation unit 412, a constant current source 414, a monitor 415 for detecting $V_F$, an amplifier 421, an A/D (analog-to-digital) converter 422, a CPU 424, an A/D converter 425, an operation program 426, a bias resistor 427, and a temperature-dependent variable resistor 428.

Based on the temperature T obtained by the absolute temperature detecting unit 411 and $nV_F$ obtained by the monitor 415, $nV_F$ at T° C. is measured, then $\partial V_F/\partial T$ is theoretically derived from T and $nV_F$ based on the equations (5) to (7), so that the exact temperature can be detected from theoretically derived $\partial V_F/\partial T$ even without correction of the fluctuation in the characteristics of the chip.

Then the current $I_F$ of the constant current source 414 is fixed before and after the arithmetic operation, and the temperature of the substrate 301 can be precisely measured by monitoring the voltage $nV_F$ of the diodes 302 of the ink jet recording element substrate. The pulse width can be obtained from the thus measured substrate temperature, according to the pulse width-T relationship giving a constant ink discharge amount as shown in FIG. 8.

Figure 9:
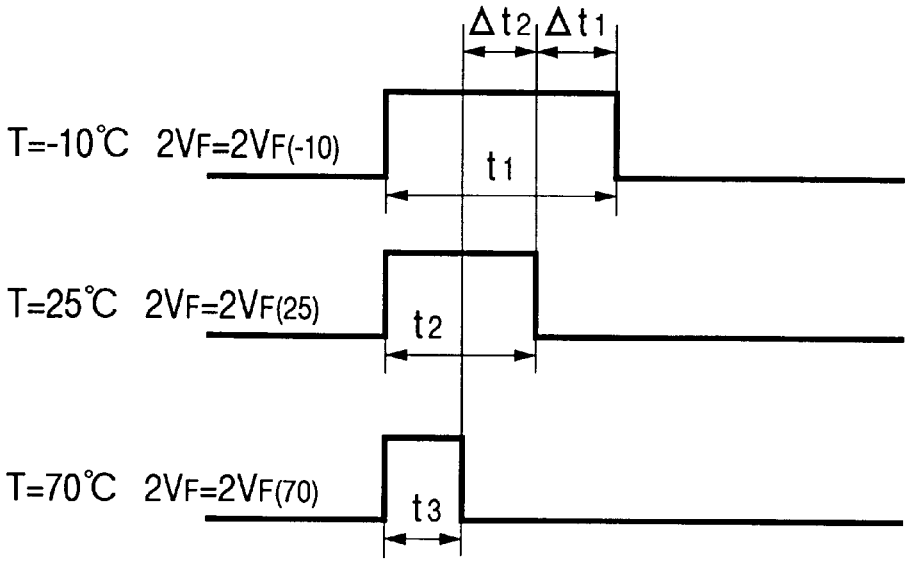
FIG. 9 is a chart showing pulse widths for obtaining the same ink discharge amount at different temperatures.
Figure 10:
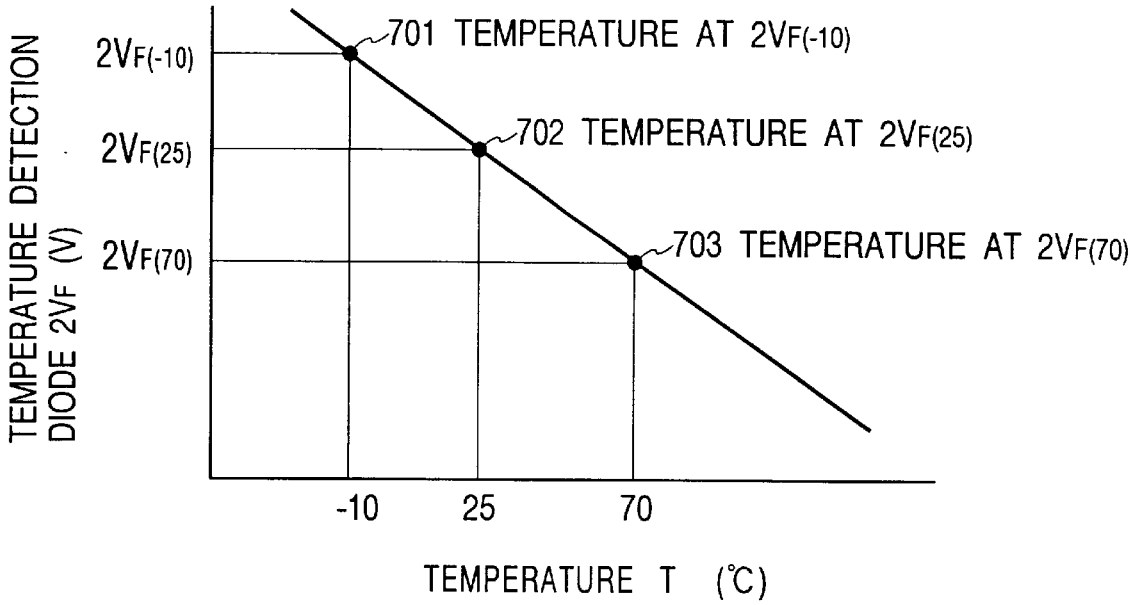
FIG. 10 is a chart for converting the output voltage of the temperature detecting diode into temperature.
Figure 11:
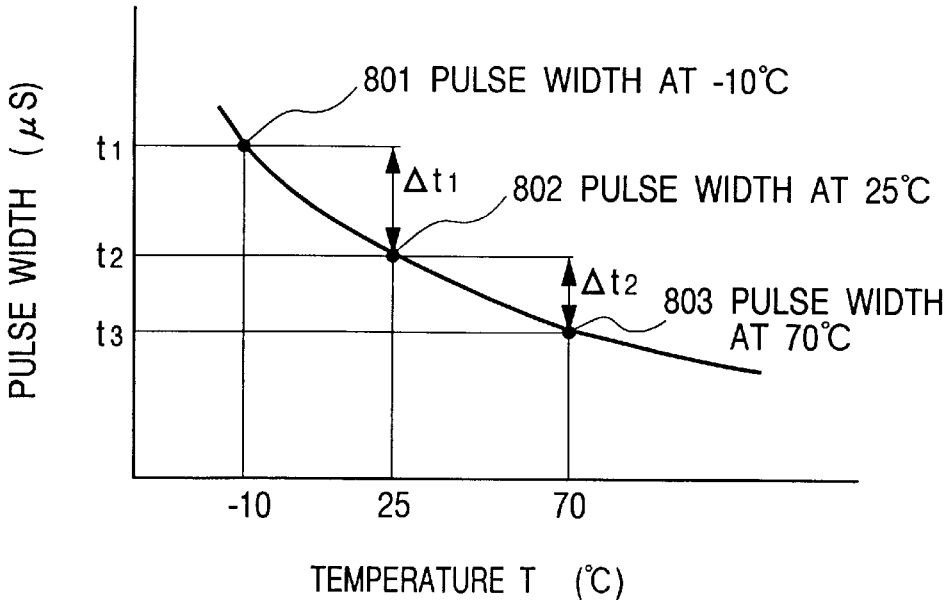
FIG. 11 is a chart showing the relationship between the output voltage of the temperature detecting diode and the pulse width for obtaining a predetermined discharge amount.
Figure 12:
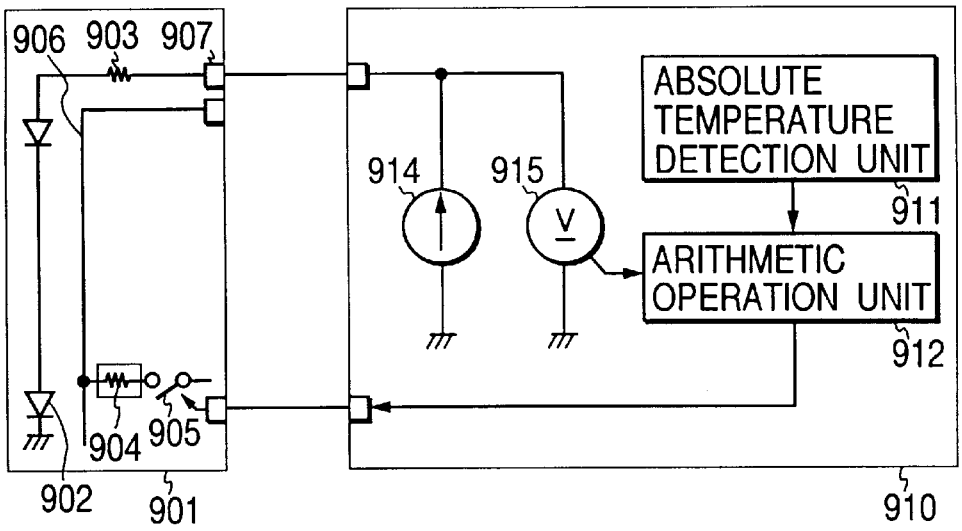
FIG. 12 is a circuit diagram showing the functions, in more detailed manner, of the temperature detecting diode and the pulse width calculation unit in a conventional element substrate for the ink jet recording head.
Figure 13:
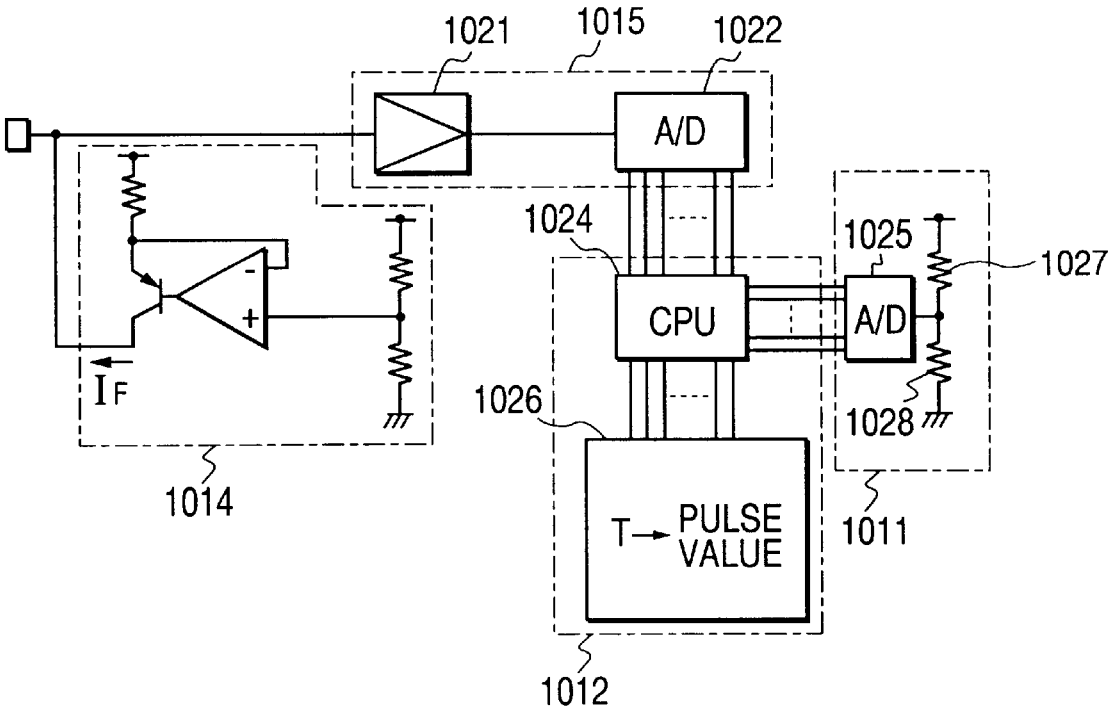
FIG. 13 is a detailed block diagram of the pulse width calculation unit shown in FIG. 12.

In contrast to the arithmetic operation unit shown in FIG. 9, which calculates the pulse width by regarding the fluctuating temperature characteristics of the diodes as constant without consideration of the relationship between $V_F$ and $\partial V_F/\partial T$, the arithmetic operation unit of the present invention shown in FIGS. 1 and 3 is featured by the fact that it derives the exact temperature even for the diodes with fluctuating characteristics, utilizing the relationship between $V_F$ and $\partial V_F/\partial T$ and calculates the corresponding pulse width.

Also in the present embodiment, the serial connection of n diodes 103 ($n \geqq 3$) provided on a head increases the signal from 2S, in the configuration shown in FIG. 9, to nS while the product $R_{a1} \times I_F$ of the resistance $R_{a1}$ of the aluminum wiring 303 and the bias current $I_F$ remains the same as in the conventional configuration, regardless of the number of the diodes, so that the S/N ratio can be improved to n/2 times in comparison with the conventional configuration and the proportion of the voltage drop caused by the resistance 303 of the aluminum wiring can be reduced to a negligible level.

In the following there will be explained, with reference to FIGS. 5 to 7, an ink jet unit IJU, an ink jet head IJH, an ink jet cartridge IJC and an ink jet recording apparatus IJRA in which the present invention can be advantageously exploited or applicable.

Figure 5:
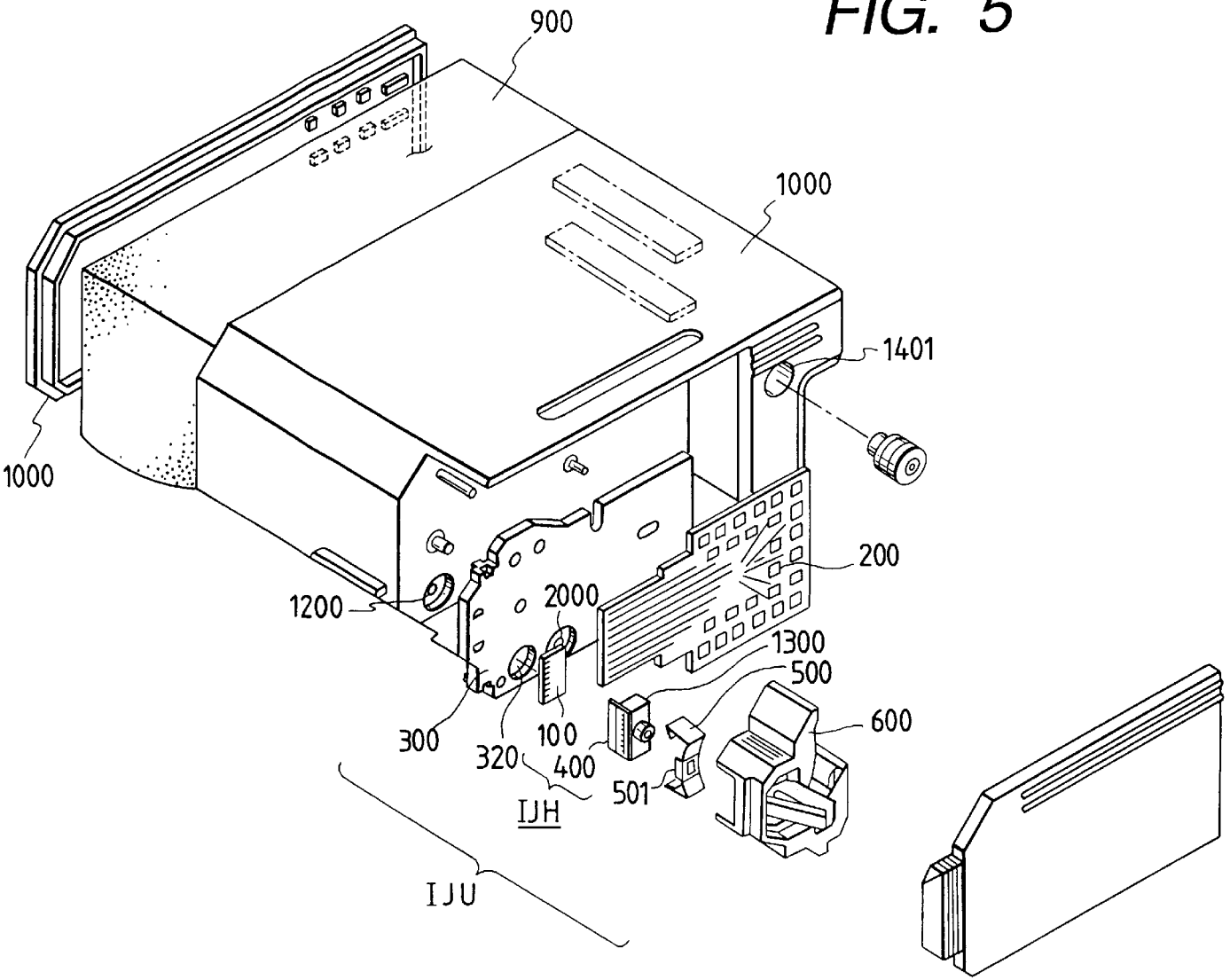
FIG. 5. is an exploded perspective view of an ink jet recording head in which the present invention is applied.
Figure 6:
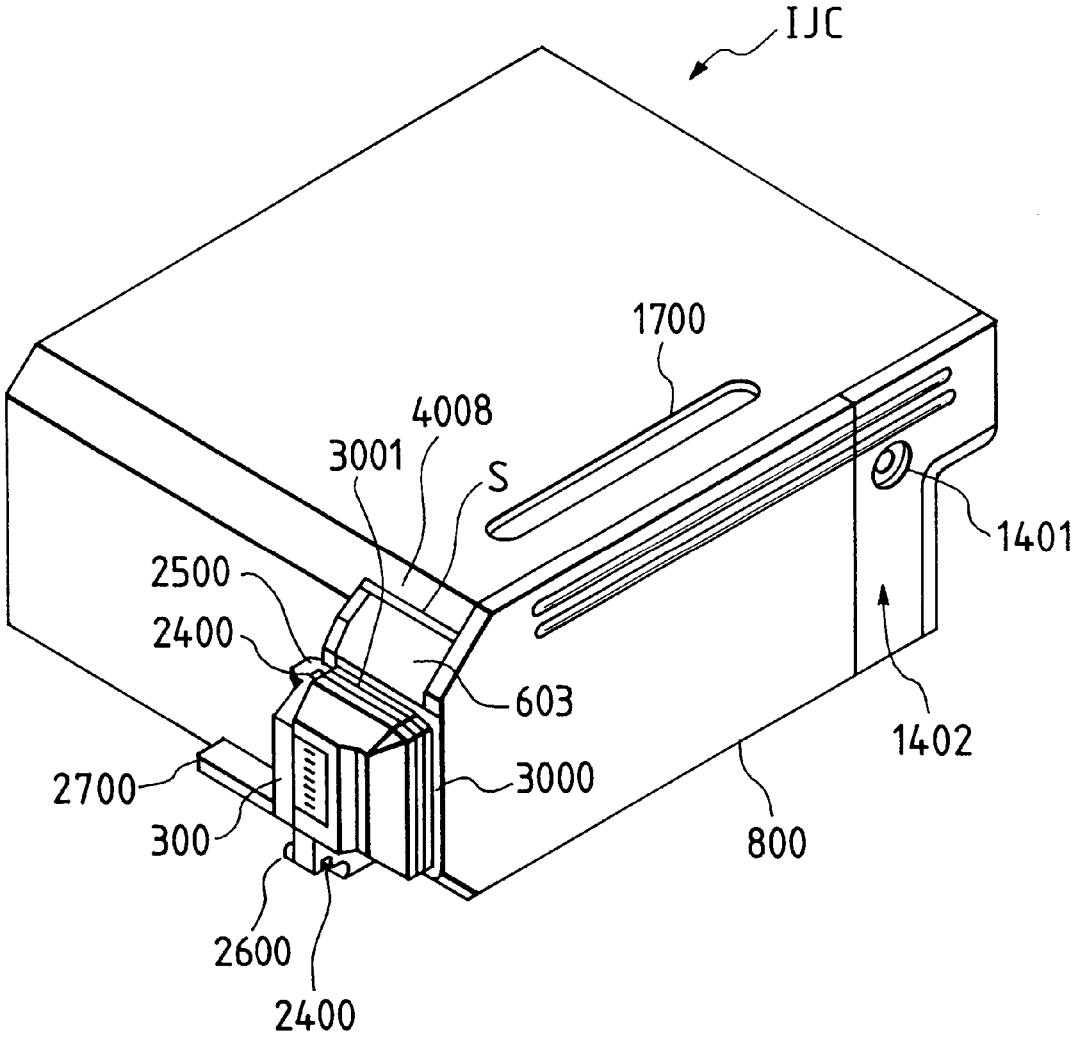
FIG. 6 is a perspective view of an ink jet recording head in which the present invention is applied.

The ink jet cartridge IJC of the present embodiment is, as shown in perspective views in FIGS. 5 and 6, integrally composed of an ink jet head unit and an ink tank for increasing the amount of the contained ink. This ink jet cartridge is supported and fixed by positioning means and electrical contacts of a carriage provided in the ink jet recording apparatus IJRA and is formed as a disposable type detachable from the carriage.

The ink jet unit IJU employs the bubble jet recording system effecting the recording by means of an electrothermal converting member, which generates, in response to an electrical signal, thermal energy for inducing film boiling in the ink.

Referring to FIG. 5, there are shown a heater board (first element substrate) 100, in which electrothermal converting members (discharge heaters), arranged in plural arrays, and electric wirings, for example of aluminum, for supplying electric power thereto, are formed on a silicon substrate by a film forming technology; and a wiring board 200 for the heater board 100.

A grooved cover plate 1300, provided with partition walls (grooves) for separating the plural ink paths and a common liquid chamber for supplying the ink paths with ink, is integrally molded with an orifice plate 400 having plural discharge openings respectively corresponding to the ink paths. Such integral molding is preferably made with polysulfone but other molding resins may also be employed.

A support member 300, composed for example of a metal and serving to support the rear face of the wiring board 200 in flat manner, constitutes a bottom plate of the ink jet unit. A pressing spring 500, constituting a pressing member, is M-shaped, pressing the common liquid chamber lightly at the center and also pressing, in a concentrated manner by a hanging portion 501 thereof, linearly, a part of the liquid paths, preferably an area thereof in the vicinity of the discharge openings. The legs of the pressing spring penetrate through holes 3121 of the support member 300 and engage with the rear face thereof to support the heater board 100 and the cover plate 1300 in mutually engaged state, and the heater board 100 and the cover plate 1300 are fixed by the concentrated biasing force of the pressing spring 500 and the hanging portion 501 thereof.

The ink tank is composed of a main cartridge body 1000, an ink absorbent member 900, and a cover member 1100 for sealing the main cartridge body 1000 after the ink absorbent member 900 is inserted therein from a side opposite to the mounting face to the unit IJU. There are also provided a supply aperture 1200 for ink supply to the unit IJU, and an externally communicating hole 1401 provided in the cover member for allowing the interior of the cartridge with the exterior.

In the present embodiment, the cover plate 1300 is composed of an ink-resistant resin, such as polysulfone, polyethersulfone, polyphenyleneoxide or polypropylene, and integrally and simultaneously molded with the orifice plate 400.

As the unit is composed of integrally molded parts, namely the ink supply member 600, the cover plate-orifice plate and the main ink tank body 1000, it can ensure a high precision of assembly and is extremely effective for improving the quality in mass production. Also, the excellent characteristics can be securely obtained as the number of the parts is reduced in comparison with the conventional configuration.

Figure 7:
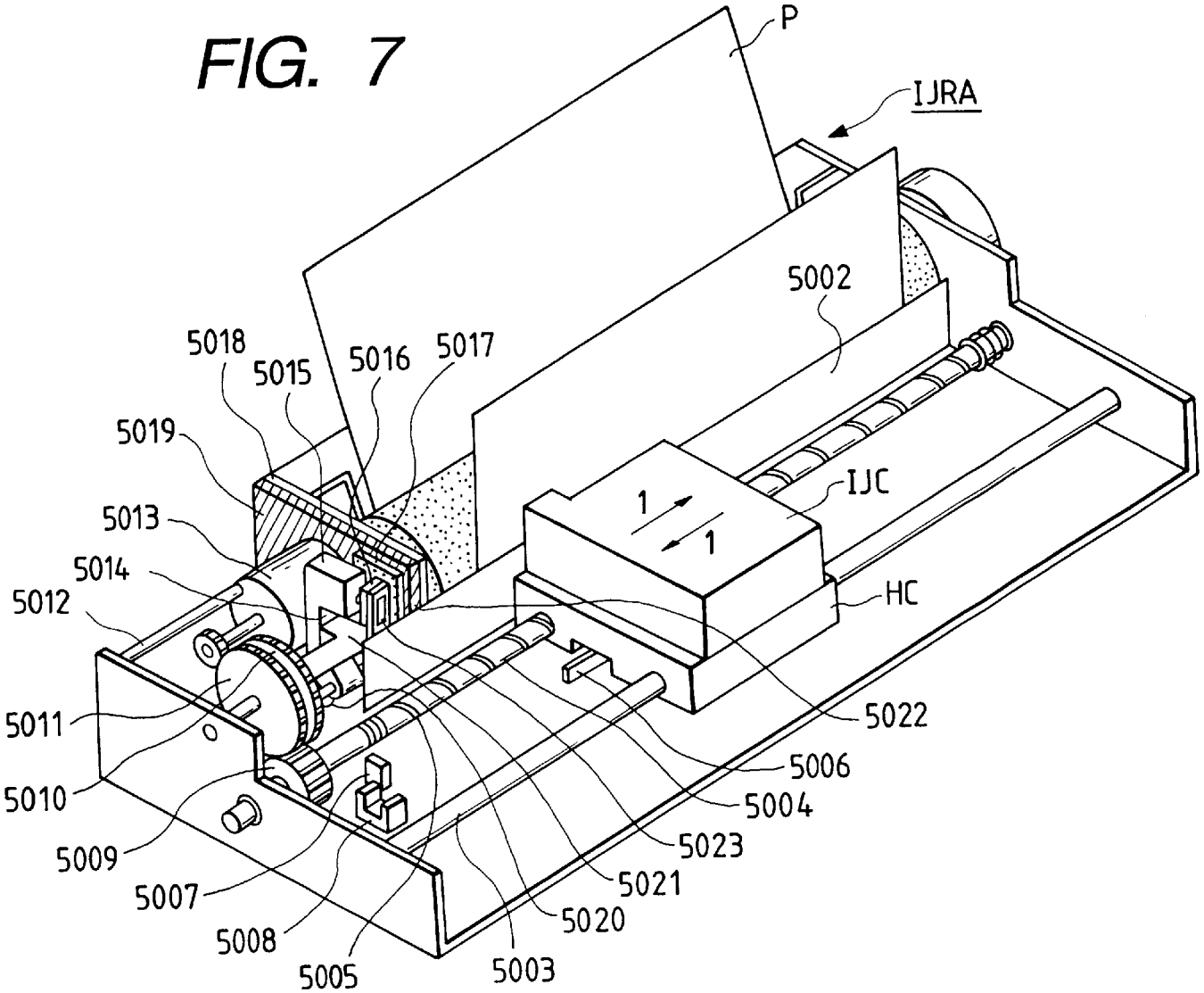
FIG. 7 is a perspective view of an ink jet recording apparatus in which the present invention is applied.

FIG. 7 is a schematic perspective view of an ink jet recording apparatus IJRA in which the present invention is applicable. A carriage HC engages by means of a pin (not shown) with a spiral groove 5004 of a lead screw 5005 rotated through transmission gears 5011, 5009 by the forward or reverse rotation of a driving motor 5013, and is thus reciprocated in directions a and b. A paper pressing plate

5002 presses paper to a platen 5000 along the moving direction of the carriage. Photocouplers 5007, 5008 constitute home position detecting means and serves to switch the rotating direction of the motor 5013, by detecting the presence of a lever 5006 of the carriage in the area of the photocouplers. A member 5016 supports a cap member 5022 for capping the front face of the recording head, and suction means 5015 is provided for sucking the interior of the cap, thus effecting suction recovery of the recording head through an aperture 5023 in the cap. A cleaning blade 5017 and a member 5019, for retractably supporting the cleaning blade, are supported by a support plate 5018. The blade is not limited to the illustrated form but the known cleaning blade can naturally be employed for this purpose. A lever 5012 for initiating the sucking operation of the suction recovery is moved by a cam 5020 engaging with the carriage, and is controlled by the driving force of the driving motor, through known transmission means, such as a clutch.

These capping, cleaning and suction recovery operations are executed at respective positions by the function of the lead screw 5005 when the carriage reaches an area of the home position, and these operations can all be employed if they are executed at known timings. The structures mentioned above are excellent singly or in combination, and constitute a preferred configuration for the present invention.

The present apparatus is further provided with drive signal supply means for driving the ink discharge pressure generating elements.

As explained in the foregoing, the serial connection of n temperature detecting diodes allows the device to increase the voltage generated by the diodes or the signal S to a level that the noise N, generated from the resistance of the aluminum wiring between the diodes and the external electrical contact, is negligible, whereby the error in the temperature measurement, resulting from such noise can be eliminated and the heater can be given a current for a precisely optimum period at each temperature. Consequently, there can be obtained a constant dot size at the ink landing point, thereby achieving higher image quality and higher definition in the recorded image.

Also, through the use of a variable constant current source as the constant current source for supplying the temperature detecting diodes with a constant current, it is rendered possible to eliminate the fluctuation of the temperature characteristics of the diodes in the manufacture thereof, by varying the electrical conditions for obtaining the temperature information from the sensor diodes based on the relationship between $V_F$ and $\partial V_F/\partial T$, thereby eliminating the error in the temperature measurement, which has resulted from the fluctuation in the temperature characteristics among different heads. Consequently, the heater can be given a current for a precisely optimum period at each temperature, and there can be obtained a constant dot size at the ink landing point, thereby achieving higher image quality and higher definition in the recorded image. Also the heater can be prevented from current supply for an excessively long period and can provide a longer service life.

Also, even in the case of supplying the temperature detecting diodes with a constant current and in the case the characteristics of the temperature detecting diodes are uncertain, it is possible to measure the temperature in precise manner by deriving $\partial V_F/\partial T$ from the temperature T obtained from the absolute temperature detecting unit and $V_F$ without defining the value of $V_F$. Also in this manner there can be obtained similar effects.

Also, by measuring $n \cdot V_F$ at an arbitrary temperature, the temperature characteristics can be calculated from the relationship between $V_F$ and $\partial V_F/\partial T$, without varying the temperature, and the temperature characteristics $\partial V_F/\partial T$ can be managed by the management of $n \cdot V_F$. A substrate of high quality can thus be provided.

What is claimed is:

1. A recording apparatus comprising:

a recording head including:

an element substrate having plural recording elements for recording; and a temperature detecting element for detecting a temperature of said element substrate;

an ambient temperature detecting unit for detecting an ambient temperature, wherein said temperature detecting element receives a current and outputs a voltage corresponding to the temperature of said element substrate;

means for setting at a predetermined value the current supplied for temperature detection to said temperature detecting element, based on a signal corresponding to the temperature obtained from said ambient temperature detecting unit and on a voltage value obtained by said temperature detecting element at the same temperature; and means for supplying to said temperature detecting element the current at the set value to detect the temperature of said element substrate.

2. A recording apparatus according to claim 1, wherein said temperature detecting element is a pn junction diode.

3. A recording apparatus according to claim 2, wherein said setting means uses the relationship between a variation rate of the voltage output by said temperature detecting element and the voltage output by said temperature detecting element.

4. A recording apparatus according to claim 1, wherein said plural recording elements comprise a heat generating member.

5. A recording apparatus according to claim 1, wherein each of said plural recording elements is a piezoelectric element.

6. A recording apparatus according to claim 4, further comprising means for transporting recording medium on which recording is to be made.

7. A recording apparatus according to claim 4, further comprising a discharge opening and an ink path corresponding to said plural recording elements, wherein said recording elements provide ink in the ink path with discharge energy to discharge the ink from said discharge opening.

8. A recording apparatus according to claim 5, further comprising means for transporting a recording medium on which recording is to be made.

9. An ink jet recording apparatus comprising:

an element substrate provided with plural electrothermal converting elements for discharging ink;

a temperature detecting element composed of a pn junction diode for detecting the temperature of said substrate;

a constant current source for supplying said temperature detecting element with an output constant current which is variable in a value thereof;

a monitor for measuring a voltage generated in said temperature detecting element by said constant current;

an absolute temperature detecting unit for detecting the absolute temperature outside said element substrate; and an arithmetic operation unit for calculating, based on the detected absolute temperature and the voltage detected by said monitor, the relationship between the absolute temperature and the detected voltage, and effecting control in such a manner as to drive said plural electrothermal converting elements for a period corresponding to the voltage detected by the monitor;

wherein the output constant current of said constant current source is variably controllable by said arithmetic operation unit, which controls the output constant current of said constant current source in such a manner that the voltage detected by said monitor becomes a constant voltage corresponding to said absolute temperature.

10. An ink jet recording apparatus according to claim 9, wherein said absolute temperature detecting unit is an analog-digital converter provided with a temperature-dependent variable resistor, said monitor is an analog-digital converter provided with an amplifier, and said constant current source with variable output current value is provided with a digital-analog converter and an operational amplifier.

11. An ink jet recording apparatus according to claim 9, wherein said temperature detecting element is a pn junction diode and is serially connected in n ($n \geqq 3$) units.

12. An ink jet recording apparatus comprising:

an element substrate provided with plural electrothermal converting elements for discharging ink;

a temperature detecting element composed of a pn junction diode for detecting the temperature, T, of said substrate;

a constant current source for supplying said temperature detecting element with a constant current;

a monitor for measuring a voltage generated in said temperature detecting element for said constant current;

an absolute temperature detecting unit for detecting an absolute temperature outside said element substrate; and an arithmetic operation unit for calculating, based on the detected absolute temperature and the voltage detected by said monitor, the relationship between the absolute temperature and the detected voltage, and controlling said plural electrothermal converting elements in such a manner that a heat generating period thereof corresponds to the voltage detected by said monitor;

wherein said arithmetic operation unit calculates, from a voltage $V_F$ detected from said temperature detecting element when a bias current is applied thereto and an absolute temperature at such detection, the relation between $V_F$ and $\partial V_F/\partial T$ and corrects the temperature based on a voltage output by said temperature detecting element.

13. An ink jet recording apparatus according to claim 12, wherein said absolute temperature detecting unit is an analog-digital converter provided with a temperature-dependent variable resistor, said monitor is an analog-digital converter provided with an amplifier, and said constant current source with variable output current value is provided with a digital-analog converter and an operational amplifier.

14. An ink jet recording apparatus according to claim 12, wherein said temperature detecting element is a pn junction diode and is serially connected in n ($n \geqq 3$) units.

15. A recording-head-detection-temperature correction method comprising the steps of:

outputting a signal corresponding to a predetermined temperature from a temperature detecting means as a reference, and outputting a signal based on a voltage obtained by supplying a predetermined current to said temperature detecting means provided at a recording head at the same temperature; and changing the predetermined current value supplied to said temperature detecting means provided at the recording head, and setting the changed predetermined current value as the current value at the temperature detection means.

* * * * *